United States Patent [19]

Hubbard

[11] 4,009,537

[45] Mar. 1, 1977

[54] AUTOMATIC ASTRAGAL

[75] Inventor: S. Eugene Hubbard, Niles, Mich.

[73] Assignee: Kawneer Company, Inc., Niles, Mich.

[22] Filed: Jan. 30, 1976

[21] Appl. No.: 653,924

[52] U.S. Cl. ..... 49/319; 49/366; 292/21; 292/92; 292/185

[51] Int. Cl.[2] ..... E06B 7/20

[58] Field of Search ..... 49/319, 316, 320, 321, 49/366–369, 394, 395; 292/21, 92, 185

[56] References Cited

UNITED STATES PATENTS

| | | | |
|---|---|---|---|
| 1,391,005 | 9/1921 | Palmer | 292/92 |
| 2,910,857 | 11/1959 | Muessel | 292/21 X |
| 3,487,581 | 1/1970 | Ellingson, Jr. | 49/366 X |
| 3,888,046 | 6/1975 | Meisterheim | 49/319 |
| 3,940,886 | 3/1976 | Ellingson, Jr. | 49/319 |

*Primary Examiner*—Philip C. Kannan
*Attorney, Agent, or Firm*—Mason, Kolehmainen, Rathburn and Wyss

[57] ABSTRACT

An automatic astragal assembly for inclusion or attachment to a door edge comprising an elongated astragal housing mounted on said door and having an outwardly opening longitudinal recess therein, an elongated astragal slidably mounted in said recess, means supporting said astragal in said recess for upward and inward relative movement in said housing in response to lifting of said astragal from lifting means mounted on an inside surface of said door, said lifting means including a lift slide mounted on said housing for reciprocal vertical movement and having an L-shaped slot defined therein with an interconnecting horizontal and vertical section and a dead lock pin engaged in said slot and secured to said astragal for elevating the same upon lifting movement of said slide, said vertical section of said slot and said dead lock pin engaging to prevent elevation of said astragal from pressure exerted against an outer edge of said astragal tending to force said astragal horizontally into said recess.

11 Claims, 11 Drawing Figures

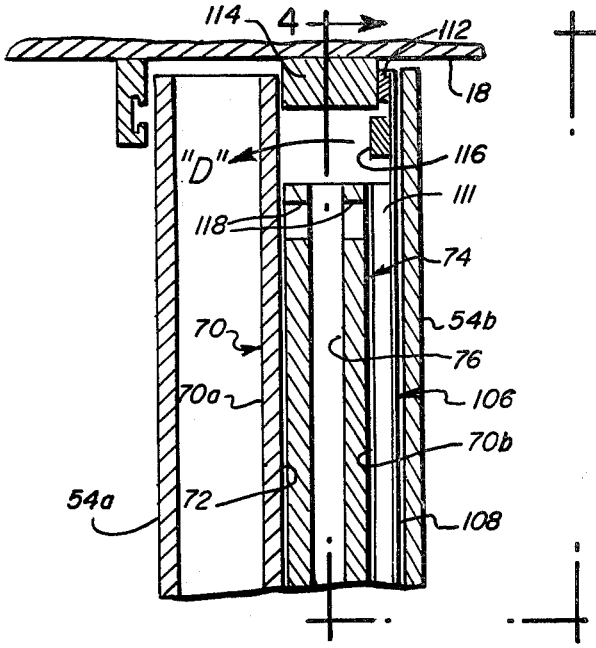
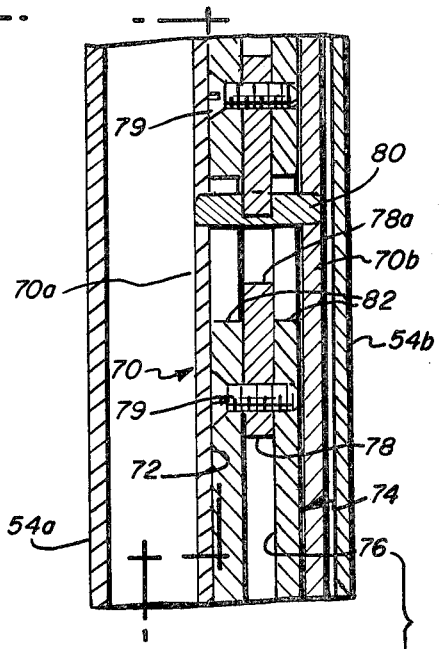
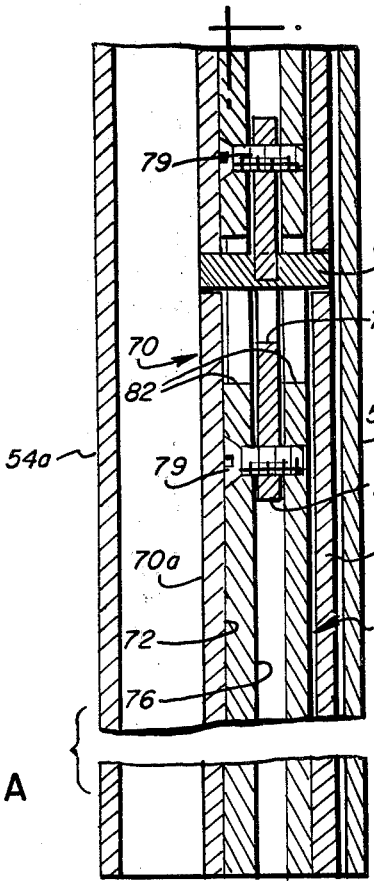
FIG. 3A
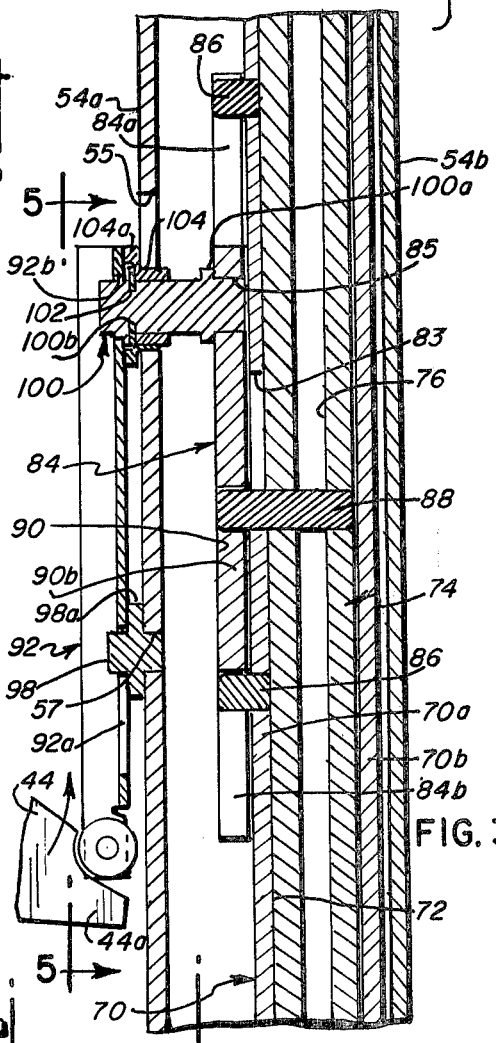
FIG. 3B
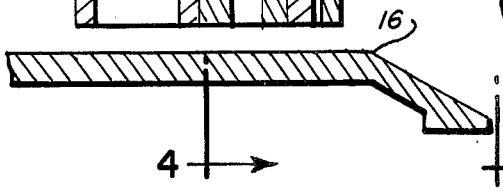

AUTOMATIC ASTRAGAL

BACKGROUND OF THE INVENTION

1. Field of the Invention

The present invention relates to an automatic astragal assembly and more particularly, to an automatic astragal assembly which can be included in or mounted on the outer or lock stile of a swingable door to bridge the gap between a pair of doors or a door and a jamb for providing increased security for an entrance. The automatic astragal of the present invention is an improvement on the astragal system shown and described in U.S. Pat. No. 3,888,046, which patent is assigned to the same assignee as the present invention.

An automatic astragal of the present invention is used with swinging doors or combinations thereof and is readily installed on existing doors with a minimum of trouble and expense.

2. Description of the Prior Art

The aforementioned U.S. patent and references cited therein are typical of prior art astragals and the automatic astragal of the present invention is adapted to provide a more simplified and economical structure for use in new doors as well as for retrofitting on existing doors already in service. The automatic astragal is particularly adapted to be operated by a crash bar of a so-called panic device or emergency unlocking device such as that shown in U.S. Pat. No. 2,910,857, also assigned to the same assignee as the present invention and incorporated herein by reference.

OBJECTS OF THE INVENTION

It is an ojbect of the present invention to provide a new and improved automatic astragal for application with the stile or edge of a swinging door.

More particularly, it is an object of the present invention to provide a new and improved automatic astragal for use with a pair of double swinging doors.

Another object of the present invention is to provide a new and improved door having a novel automatic astragal assembly associated therein for providing improved security against unauthorized entrance of the building or room from outside the door.

Another object of the present invention is to provide a new and improved automatic astragal assembly of the character described which is greatly simplified in construction, easy to operate, economical to make and virtually trouble-free in operation.

Yet another object of the present invention is to provide a new and improved automatic astragal which is especially adapted to be retrofitted onto existing swinging entrance doors.

Another object of the present invention is to provide a new and improved automatic astragal assembly which is operatively interconnected with a panic or emergency exit bar for automatic retraction of the astragal when the door is opened by use of the panic bar.

Still another object of the present invention is to provide a new and improved automatic astragal assembly of the character described which provides greatly improved security against unauthorized entrance obtained by insertion of a tool or wire in the space between the meeting edges of a pair of doors or space between the edge of a door and the adjacent door jamb.

Another object of the present invention is to provide a new and improved automatic astragal which provides improved entrance security and prevents contraction of the astragal by pressure on the astragal applied by insertion of a pry bar or tool or the like tending to force the astragal into its housing on the stile of the door.

Further objects and advantages of the present invention will become apparent as the following description proceeds and the features of novelty which characterize the invention will be pointed out with particularity in the claims annexed to and forming a part of this specification.

SUMMARY OF THE INVENTION

In accordance with the foregoing and other objects and advantages of the present invention, one embodiment by way of representation and not limitation comprises an automatic astragal assembly mounted on a door stile and including an elongated astragal housing having an outwardly opening recess therein. An elongated astragal is mounted in the recess and means is provided for supporting the astragal within the recess for upward and inward relative movement therein in response to vertical lifting of the astragal by means of an adjacent inside surface of the door. Lifting means is provided for controlled elevation of the astragal in the recess of the housing and includes a lift slide mounted on the housing for vertical sliding movement. The slide includes an L-shaped slot defined therein having interconnecting horizontal and vertical sections. A dead lock pin is engageable in the slot and is secured to the astragal for elevating the same when the slide is lifted. Engagement of the dead lock pin within the vertical leg or section of the slot prevents the astragal from being retracted in response to horizontal pressure on the astragal itself in a direction tending to force and retract the astragal into the recess of the housing. The astragal thus provides a positive lock against jimmying by the use of a pry bar or tool inserted in the space between the door and an adjacent jamb or the gap between the outer edges of a pair of swinging doors.

BRIEF DESCRIPTION OF THE DRAWINGS

For better understanding of the present invention, reference should be had to the following detailed description taken in conjunction with the drawings, in which:

FIGS. 3A and 3B comprise a longitudinal cross-sectional view taken substantially along lines 3—3 of FIGS. 2 and FIGS. 4A and 4B;

DESCRIPTION OF THE PREFERRED EMBODIMENTS

Figure 1:
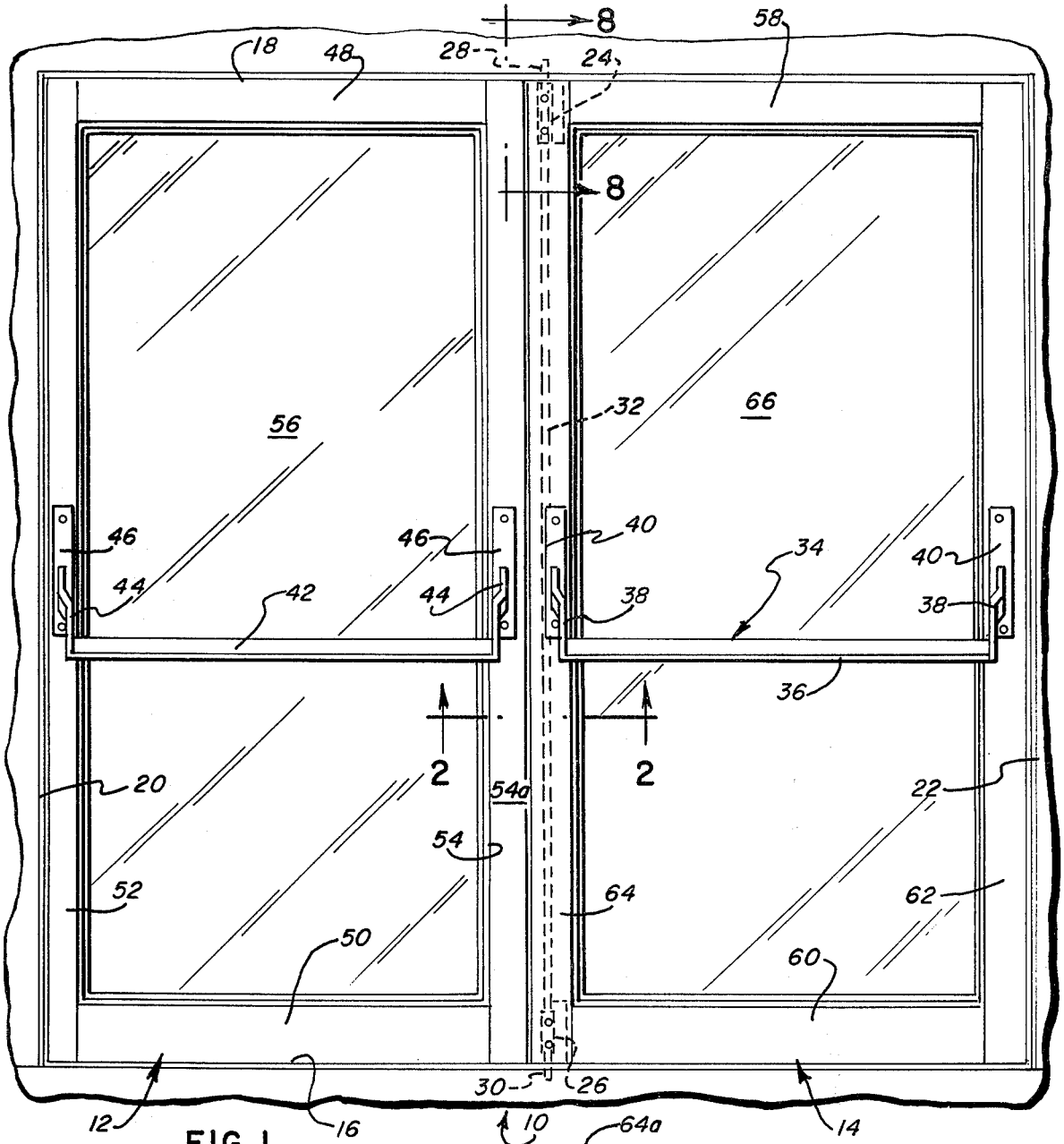
FIG. 1 is an elevational view of a building entrance employing a pair of swingable doors with an automatic astragal assembly in accordance with the features of the present invention, as viewed from inside of the building.

Referring now more particularly to the drawings, therein is illustrated a building entrance way generally indicated by the reference numeral 10 and employing a pair of swinging doors 12 and 14 adapted to control the traffic through the entrance. The entrance way is framed by a lower threshold 16, an upper transom member or header 18 and a pair of side members or door jambs 20 and 22 on which the respective doors 12 and 14 are hingedly attached. During normal operation, the door 14 is an inactive door and is maintained in a closed position by means of a pair of upper and lower bolt assemblies 24 and 26 having respective bolt members 28 and 30. When locked or closed, the bolts project upwardly and downwardly, respectively, into slots or openings in the header 18 and sill or threshold 16.

Actuation to retract the bolts of the upper and lower bolt assemblies on the inactive door is controlled by a vertically movable bolt rod 32. The bolt rod is movably controlled by an emergency panic device generally indicated as 34 and preferably of the type shown and described in the aforementioned U.S. Pat. Nos. 2,910,857 and 3,888,046, which patents are incorporated herein by reference. The panic device 34 includes a horizontal crash bar 36 attached at opposite ends to the lower end of a pair of support arms 38 pivotally mounted on pins carried by a pair of housings 40 attached to the opposite stiles of the door frame. The door 12 is provided with a similar crash bar 42 attached at its opposite ends to the lower ends of a pair of support arms 44. These arms are pivotally supported on pins carried by a pair of housings 46 secured to the opposite stiles of the frame of the active door 12.

Figure 2:
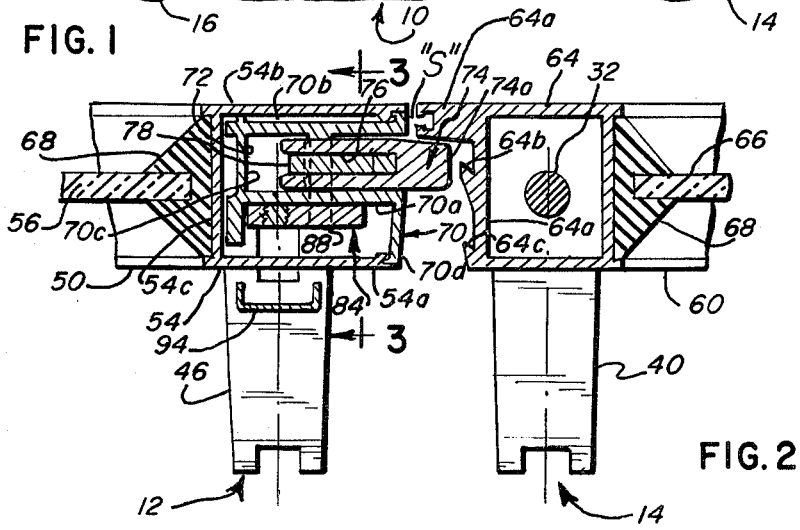
FIG. 2 is a fragmentary, horizontal cross-sectional view taken substantially along lines 2—2 of FIG. 1.

The active door includes a rectangular frame comprising an upper rail 48, a lower rail 50, a pivot stile 52 hingedly attached to the door jamb 20 and a lock stile 54. The frame members are interconnected at opposite ends and provide support for a glazing panel 56 or the like mounted in the large glazing opening defined by the door frame. Similarly, the inactive door 14 includes a rectangular frame comprising an upper rail 58, a lower rail 60, a pivot stile 63 hingedly attached to the door jamb 22 and a lock stile 64. These frame members are interconnected to form an opening supporting a glazing panel 66 or the like. As shown in FIG. 2, the glazing panels 56 and 66 of the respective doors are secured in place in the openings defined by their respective door frames by suitable glazing elements such as the retaining gaskets 68 and except for the modified lock stiles 54 and 64, doors 12 and 14 may be of the type shown in U.S. Pat. No. 3,774,360 which patent is also incorporated herein by reference and is assigned to the same assignee as the present application.

In accordance with the present invention, the lock stile 54 of the active door 12 is of channel-shaped cross-section including a pair of side flanges **54*a* and 54*b* and an integral web 54*c*. The stile is open along its outwardly facing side in order to receive an elongated astragal housing, generally indicated by the reference numeral 70. The astragal housing is interlocked with outer edge portions of the side flanges 54*a* and 54*b* of the door stile as best shown in FIG. 1 and includes a longitudinal, inwardly extending slot or recess 72 formed by a pair of parallel, opposite, housing side walls 70*a* and 70*b* integrally joined by a bight or base wall 70*c*. Along their outer edges, the side flange 54*b* of the stile and the flange 70*b* of the astragal housing are interlocked together as shown in FIG. 2 and along the outer edge, the housing side flange 70*a* is integrally joined with a jamb facing member 70*d* which is interlocked with the outer edge of the side flange 54*a*** of the door stile.

As shown in FIG. 3, tongue and groove connections are provided to interlock between the flanges **54*a* and 54*b* of the door stile and the wall sections 70*d* and 70*b* respectively, of the astragal housing 70 so when these members are interconnected to compliment one another, a relatively strong structure with a longitudinal recess 72 defined therein is formed for receiving an elongated astragal 74. The astragal 74 is relatively thick and heavy and includes an outer or nose portion 74*a* (FIG. 2) which bridges the gap or space S between the closest facing portions of the rails 54 and 64 of the respective doors 12 and 14. More particularly, the door stile 64 of the inactive door is formed with a projecting nose portion 64*a* which overlaps the nose portion 74*a* of the astragal when the astragal is in the outwardly extending position as shown in FIG. 2, with the nose portion projecting outwardly of the recess 72 in the astragal housing 70. With the extended astragal and the nose portion 64*a*of the inactive door 14 in the position shown in FIG. 2, it is extremely difficult or impossible for a tool, wire, or other implement to be inserted through the space or gap S between the meeting door stiles from outside of the building to hook and depress either or both of the crash bars 36 and 42 for gaining unauthorized entry into the building. In order to further minimize the possibility of unauthorized entry into the building, the door stile 64 of the inactive door 14 is formed with a pair of wire or tool intercepting ridges 64*b* and 64*c* formed on an outwardly facing jamb surface 64*d* and should a wire or tool somehow be passed through the gap or space S between the confronting portions of the astragal nose 74*a* and the lock stile nose 64*a*, the ridges 64*b* and 64*c*** will then engage and intercept at the end of the wire or tool making it extremely difficult to achieve further penetration for the purpose of opening the door.

The body of the astragal 74 is formed with an elongated slot 76 defined along the back or inside edge and is supported in the recess 72 of the astragal housing 70 for inwardly and upwardly directed relative sliding movement from the outwardly extending position as shown in FIG. 2. The astragal is provided with a pair of support plates 78 having diagonal slots **78*a* defined therein as best shown in FIGS. 3A, 3B, 4A and 4B spaced vertically apart in the slot 76 adjacent the upper and lower end portions. The plates are secured in place by cap screws 79**.

Figures 4A, 4B:
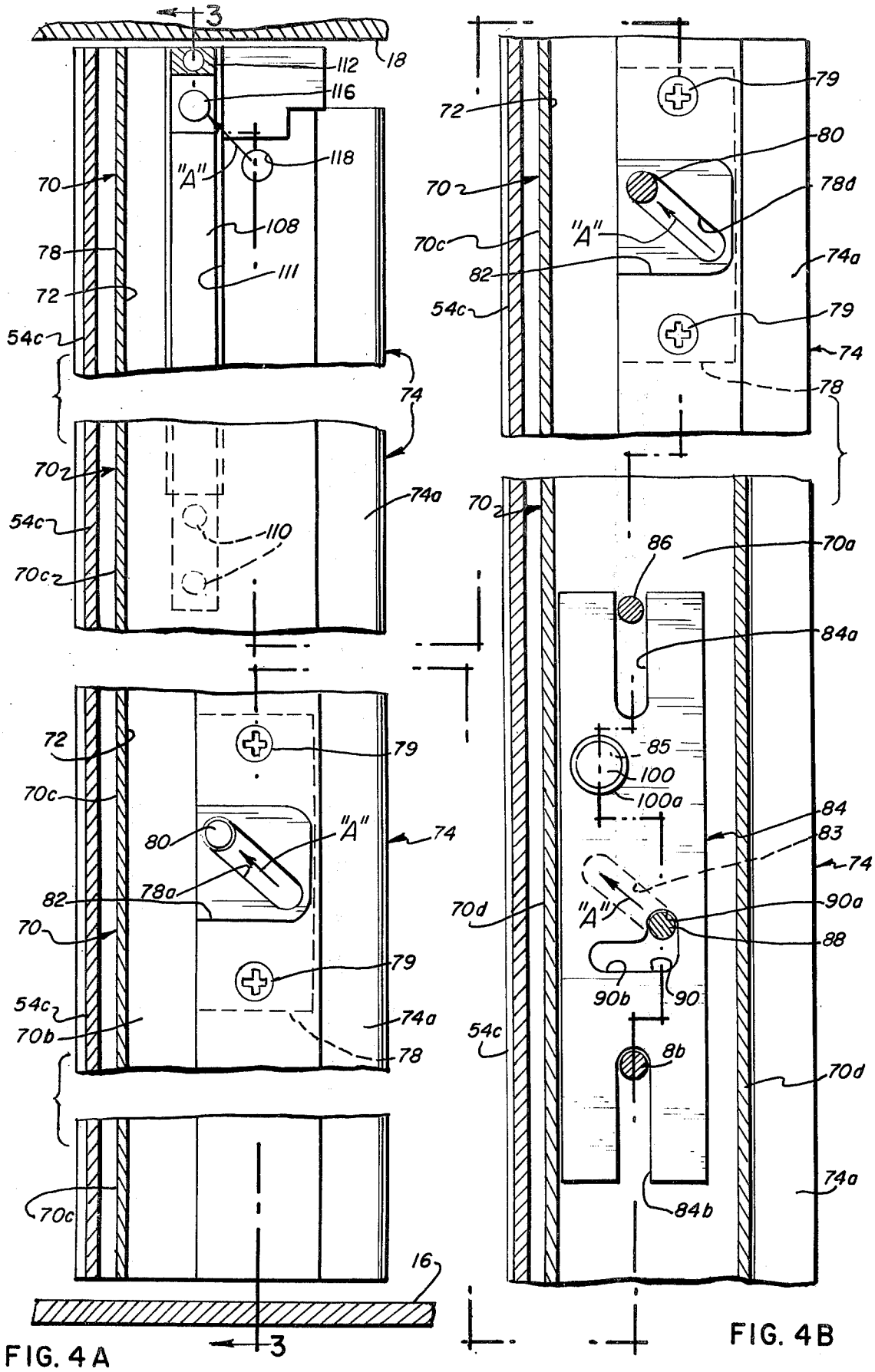
FIGS. 4A and 4B comprise a longitudinal cross-sectional view taken substantially along lines 4–4 of FIGS. 3A and 3B.

Within each of the slots **78*a* there is provided a supporting cross pin 80 having opposite ends seated and supported in circular apertures formed in the side wall sections of the astragal 74 defined on opposite sides of the recess 76. As best shown in FIG. 4A and 4B, the dead weight of the astragal causes it to normally move into the outwardly extending position and in this position, guide pins 80 engage the upper ends of the slots 78*a* and thereby limit further downward and outward travel of the astragal. Elevation or lifting of the astragal (as will be hereinafter described), cause the astragal to move upwardly and inwardly on the slope as indicated by the arrows A, (FIGS. 4A and 4B) because of the interaction between the support or guide pins and the sloping slots 78***a* of the plates. In order to accommodate the relative movement between the guide pins 80 and the astragal 74, the side wall sections of the astragal on opposite sides of the support plates 78 are cut away with recesses or slots 82 as best shown in FIGS. 4A and 4B. Preferably, the support plates 78 are positioned on the astragal 74 adjacent the upper and lower end portions so that continuous parallel alignment between the outer surface of the astragal nose 74*a* and the outer edge of the door stile 54 is maintained without binding as the astragal is lifted and consequently moves both upwardly and inwardly.

In order to retract the astragal 74 by operation of the crash bar 42 so that the active door 12 may be opened, there is provided a lift slide 84 having a pair of vertically aligned slots 84*a* and 84*b* adjacent the upper and lower end portions of the slide. Engaged within these slots to maintain and support the slide member 84 on the outer surface of the wall portion 70*a* of the astragal housing 70, there is provided a pair of slide pins 86 secured in the housing wall portion and vertically spaced apart by a distance slightly less than the distance between one end of the slide 84 and the inner end of the vertical slot on the opposite end of the slide. Engagement between the surfaces of the slots 84*a* and 84*b* and the respective pins 86 limits the vertical travel of the slide on the astragal housing to a distance slightly less than the vertical length of the respective slots. The slide 84 is interconnected with the astragal 74 by means of a dead lock pin 88 secured within circular apertures provided in the wall sections of the astragal and projecting outwardly thereof through a diagonal slot 83 in the housing wall 70*a*, which slot is parallel with the slots 78*a* and substantially equal in length thereto. When the astragal is in the outwardly projecting position as shown in FIGS. 4A and 4B, the lock pin 88 is seated adjacent the lower end of the diagonal slot 83 in the wall section 70*a* of the astragal housing, as shown. Upward movement of the slide causes the lock pin 88 to eventually lift and carry the astragal 74 upwardly and inwardly as indicated by the arrows A.

In accordance with the invention, the slide 84 is formed with an L-shaped slot 90 having a short vertical leg 90*a* and a longer horizontal leg 90*b*. When the astragal is in the outward position as shown in FIGS. 4A and 4B, the dead lock pin 88 engages the upper end of the vertical leg 90*a* of the L-shaped slot. In this position, the astragal is locked against inward movement by any force exerted horizontally inwardly against the nose portion 74*a* by a tool or the like. The engagement of the lock pin 88 and the inner edge of the vertical section 90*a* of the L-shaped slot provides a dead lock bolt type of security and positively prevents retraction of the astragal should a tool or pry bar be inserted into the space S between the door stiles 54 and 64. After the slide 84 is elevated vertically on the wall 70*a* of the astragal housing to the point wherein the lock pin 88 is below the vertical leg portion 90*a* of the L-shaped slot, the astragal then may be moved inwardly as it moves upwardly because of the lifting engagement between the lower edge surface of the horizontal leg 90*b* of the L-shaped slot and the dead lock pin 88. The L-shaped slot and dead lock pin provides positive bolt action against inward movement of the astragal from an outwardly applied force on the nose portion yet permits elevation and retraction of the astragal by vertical lifting movement exerted from the slide 84.

As shown in FIG. 2, the slide 84 is positioned between the wall 70*a* of the astragal housing 70 and the inside wall 54*a* of the door stile 54.

Figure 6:
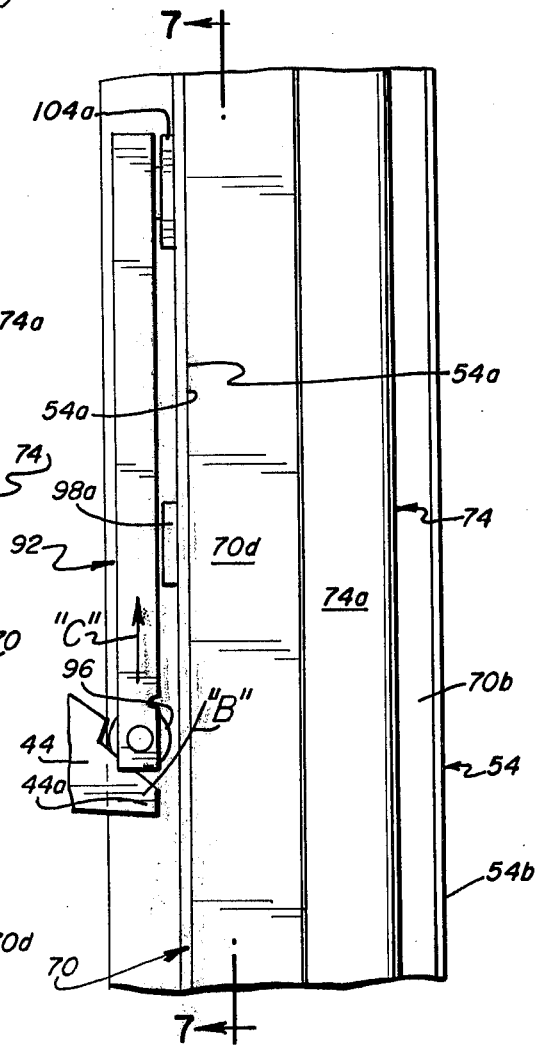
FIG. 6 arrows a fragmentary, elevational view looking in the direction of arros 6—6 of FIG. 5.

An exterior slide 92 of channel-shaped, cross-section is mounted adjacent the outer face of the door stile wall surface 54*a* for vertical sliding movement within a guide channel 94 (FIG. 2) contained in the crash bar pivot housing 46. At its lower end, the exterior slide is provided with a roller 96 which is engaged by the inner end or toe portion 44*a* of the crash bar support arm 44 which is journaled for pivotal movement in the housing 46. As shown in FIG. 6, when the crash bar 42 is depressed downwardly, the inner end portion of the arms 44 are pivoted upwardly as indicated by the arcuate arrow B. When this occurs, the upper surface on the toe 44*a* of the arm engages the roller 96 and causes the exterior slide 92 to move upwardly in a vertical direction relative to the door stile as indicated by the arrow C.

Figure 5:
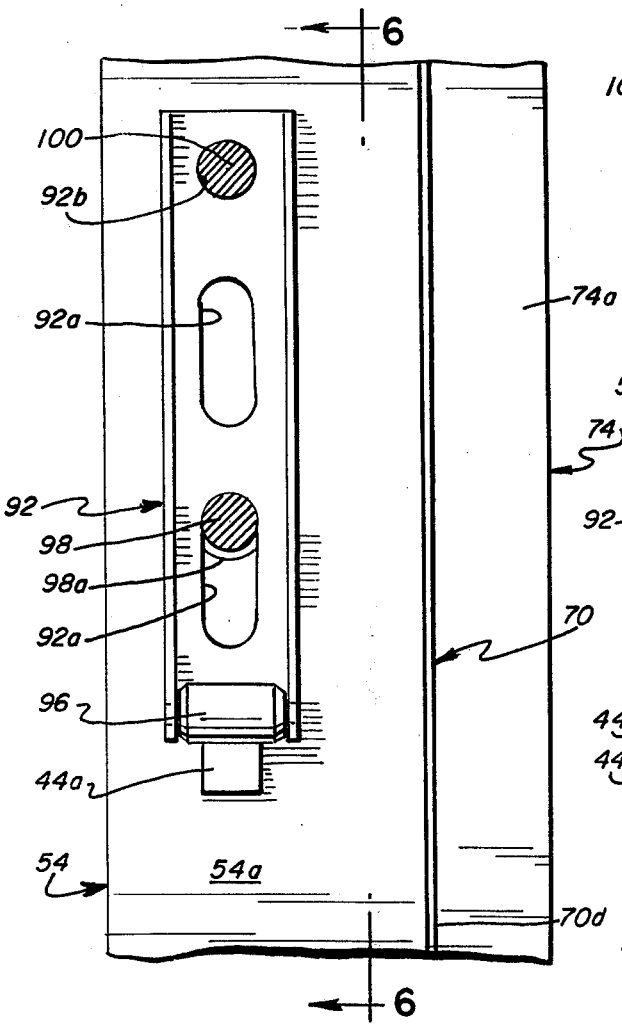
FIG. 5 is a fragmentary, elevational view looking in the direction of the arrows 5—5 of FIG. 3B.

The web portion of the exterior slide 92 is formed with a pair of elongated slots 92*a* and a circular aperture 92*b* adjacent the upper end. As shown best in FIGS. 3B and 5, the lower slot 92*a*, of the slide is engaged by a grommet-like button 98 having a radial flange 98*a* intermediate its length to provide spacing between the web of the slide and the outer surface of the stile wall 54*a*. The circular opening 92*b* in the slide encircles the outer end portion of a lift pin 100 (as best shown in FIG. 3B) which mechanically interconnects the outer slide 92 with the inner slide plate 84. The inner end portion of the lift pin is seated in a circular aperture 85 formed in the slide plate 84 and the pin includes a radial flange 100*a* abutting the outer surface of the slide plate. The lift pin is formed with an annular groove 100*b* spaced outwardly of the flange 100*a* for receiving a retaining washer 102 of the split ring type seated within the outwardly opening, enlarged cup portion 104*a* of a tubular grommet 104. The body portion of the grommet 104 is slidably disposed in an elongated slot 55 formed in the door stile wall 54*a* and is spaced vertically in line with and above a circular aperture 57 (FIG. 3B), in which is seated at the inner end portion of the slide button 98. Preferrably, the slide button 98 and the grommet 104 are formed of low friction plastic materials such as Nylon or Teflon and the flanges 98*a* and 104*a* thereof, provide sliding spacers between the wall surface 54*a* of the door stile and the web portion of the exterior slide 92, as shown in FIG. 6.

From the foregoing, it will be seen that the astragal 74 is automatically elevated and retracted when downward and inward pressure is exerted on the crash bar 42 of the active door 12. Movement of the bar pivots support arms 44 and the inner end portion 44*a* move upwardly. This action (as shown in FIG. 6) causes the external slide 92 to move upwardly in the direction of the arrows C and this in turn via the lift pin 100 causes the interior slide 84 to move vertically upward and carry the astragal 74 upwardly while retracting it inwardly into the housing recess 72 as described. When the outer end of the nose portion 74*a* of the astragal clears the outer edge of the nose 64*a* on the stile 64 of the inactive door 14, the active door 12 is then free to pivot open and allow traffic through the entrance.

Referring now to FIG. 3A, in order to retain the astragal 74 in the upwardly and inwardly retracted position after the door 12 is opened, a spring latch mechanism (generally indicated by the reference numeral 106) is provided adjacent the upper end portion of the door stile. The latch mechanism includes an elongated flat leaf spring 108 attached at its lower end portion to the outer surface of the housing side wall 70*b* by a pair of rivets or screws 110 (FIG. 4A). Above the point of attachment of the leaf spring, the housing side wall 70*b* is formed with an elongated slot 111 open at the upper end as shown. The upper end portion of the leaf spring is normally biased inwardly towards the astragal as shown by the arrow D (FIG. 3A). When the door 12 is in the closed position, and the astragal is in the locking or outwardly extended position, the inward bias of the upper end portion of the leaf spring is limited by engagement of a bumper pad 112 attached to the upper end of the spring with the outwardly facing surface of a stop block 114 secured to the door frame header 18. Immediately below the bumper pad 112 there is provided a circular catch pin 116 mounted on the inside surface of the leaf spring and, as shown in FIG. 4A. When the astragal 74 is elevated and retracted inwardly to move upwardly in the direction of the arrow A, a circular aperature 118 of slightly larger diameter than the catch pin will become aligned to receive the pin. When the door is opened far enough, so that the bumper pad 112 is no longer in engagement with the stop block 114, the leaf spring 108 snaps the catch pin 116 into latching position in the aperture 118 in the outwardly facing side surface of the astragal 74. This latching engagement holds and retains the astragal in the retracted position as long as the door is in an open position with the bumper pad 112 away from the stop block 114. When the door is again closed, the bumper pad 112 engages the stop block 114 and the upper end of the latch spring is forced outwardly in the direction opposite the arrow D, FIG. 3A. This retracts the catch pin 116 on the upper end portion of the spring from out of the circular opening 118 adjacent the upper end of the astragal 74 and when the retraction is completed the astragal 74 is then free to slide downwardly and outwardly in a direction opposite the arrows A (FIG. 4A) to assume the extended locking position until the door is again operated by depression of the crash bar 42 on the active door 12.

When the door is opened, the astragal 74 is elevated and is automatically retained in the upward, retracted position by the catch pin 116 on the upper end of the leaf spring 108 which is engaged in the aperture 118. When the door is returned to the closed position this pin is disengaged from the astragal and allows the astragal to return to the normal outwardly extended locking position.

Figure 7:
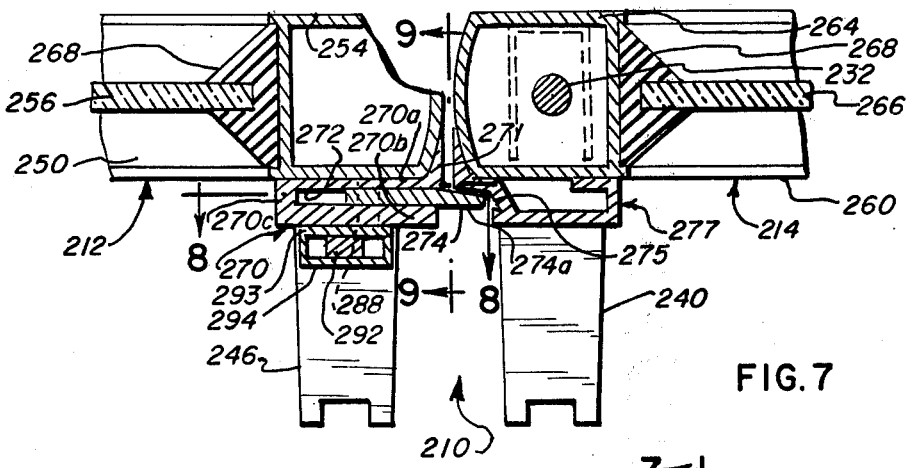
FIG. 7 is a fragmentary, horizontal cross-sectional view, similar to FIG. 2, but illustrating another embodiment of an automatic astragal assembly in accordance with the features of the present invention which is especially adapted for installation on existing doors already in service.
Figure 8:
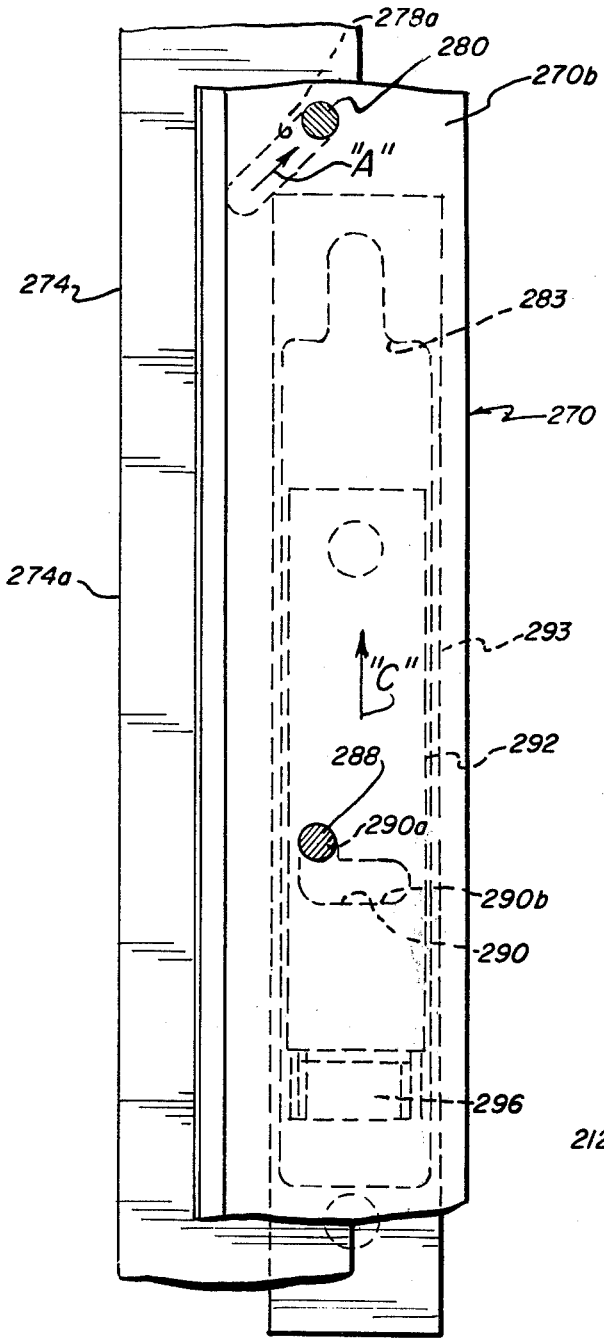
FIG. 8 is a fragmentary, cross-sectional view, with portions in phantom, taken substantially along lines 8—8 of FIG. 7.
Figure 9:
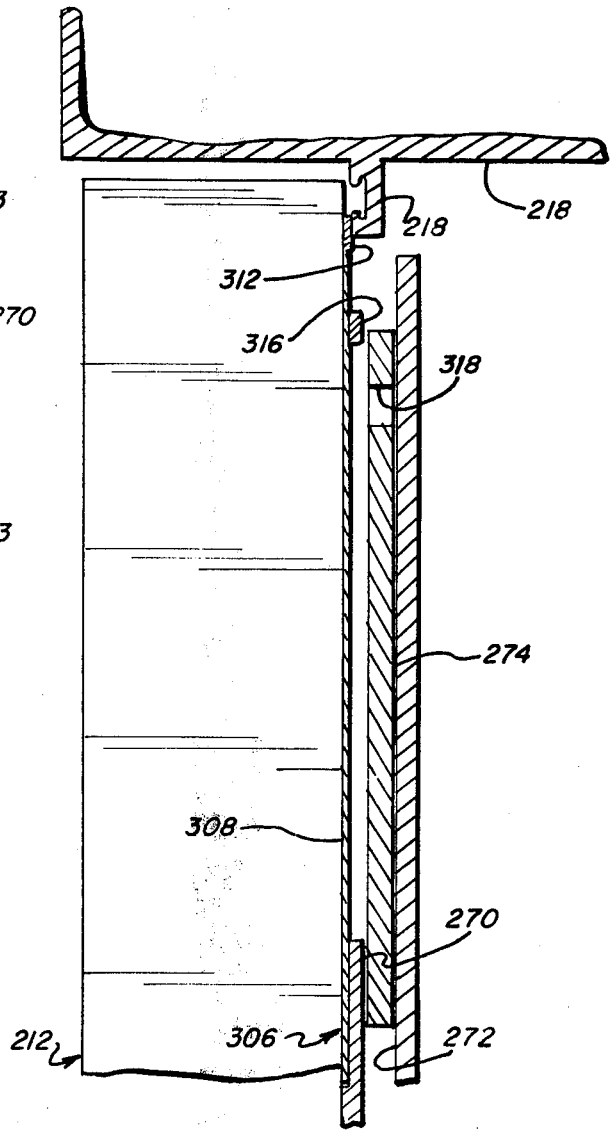
FIG. 9 is a fragmentary cross-sectional view taken substantially along lines 9—9 of FIG. 7.

Referring now to FIGS. 7, 8 and 9, therein is illustrated another embodiment of an automatic astragal constructed in accordance with the present invention and especially adapted for use on existing swinging doors. Reference numerals 200 and higher, than those used for identifying similar components in the embodiment of FIGS. 1–6 will be used for the components in the automatic astragal system illustrated in FIGS. 7–9 and only the differences in the two astragal systems will be described herein in detail. In FIGS. 7–9 there is illustrated an automatic astragal system which is especially adapted to be installed on existing swinging doors of entrances. An active door 212 and an inactive door 214 are swingably mounted in an entrance 210 and the doors include conventional, tubular cross-section, outer door stiles 254 and 264, respectively, having a curved outer surface adapted to closely face the similar surface of the adjacent stile when the doors are closed as shown in FIG. 7.

The automatic astragal system in accordance with the present invention, includes an external astragal housing 270 mounted on the door stile 254 and having a recess 272 opening outwardly toward the inactive door 214 and adapted to slidably receive an elongated astragal 274. The housing 270 includes an inside wall 270*a* attached to the inside wall section of the door stile 254 and a flanged portion 271 is formed along the outer edge of the wall 270*a* to abut closely against the curved outer surface of the stile, as shown in FIG. 7 to guide in the alignment and installation of the housing 270 on the door. The astragal housing also includes a parallel outer wall 270*b* and a bight portion 270*c* which defines the botton of the astragal recess 272. As best shown in FIG. 8, the elongated astragal 274 is supported in the recess 272 of the housing 270 on a plurality of vertically spaced guide pins 280 which project into circular openings formed in the opposite walls 270*a* and 270*b* of the housing. These guide pins are engaged in upwardly and inwardly sloping slots 278*a* formed in the body of the astragal 274. When the astragal is lifted upwardly by depression of the associated crash bar on the door, the astragal also retracts inwardly in the direction indicated by the arrow A of FIG. 8 relative to the astragal housing 270.

The astragal includes an outer nose portion 274*a* and when the astragal is fully extended as shown in FIGS. 7 and 8, the nose portion closely fits within a receiving recess 275 directly facing the astragal and defined in a second housing member 277 attached to the inside wall surface of the door stile 264 of inactive door 214. The inside facing surfaces of the housings 270 and 277 are aligned as shown in FIG. 7 to provide a pleasant appearance and a tortuous passage is defined between the housing flange section 271, the nose portion 274*a* of the extended astragal 274 and the closely spaced, facing portions of the housing 277 on the inactive door 214. This close spacing makes it very unlikely or impossible for an unauthorized person to insert a tool or wire between the door stiles 254 and 264 in order to depress or move the astragal 274 inwardly by depression of the crash bars on the door.

The respective housings 270 and 277 are attached to the door stile by suitable fasteners such as self-tapping screws or the like and when in place, give the door a pleasing appearance not unlike the inside surfaces of the door stile 254 and 264 themselves before the housings were attached. Panic devices (not shown) are associated with each door and include support arm housings 240 and 246 attached to the respective housings 270 and 277. Suitable adjustments in length are made to the respective support arms of these panic devices. The automatic astragal assembly does not use both an inner and an outer slide as in the previous embodiment, but includes only a single slide member 292 mounted on a plate 293 attached to the wall of the housing 270. The slide is formed with an L-shaped slot 290 for engagement with a dead lock pin 288 in an arrangement like that of the prior embodiment. The pin projects through a relatively large opening 283 (FIG. 8) formed in the wall 270*b* of the housing and when the slide 292 is elevated in a vertical direction as shown by the arrow C, no movement of the astragal is achieved until the dead lock pin 288 engaged against the lower surface of the horizontal section 290*b* of the L-shaped slot. The slide is moved upwardly by engagement of the inner end of a crash bar support arm with a roller 296 on the lower end as in the prior embodiment and after the initial upward travel of the slide, contact of the dead lock pin 288 against the lower surface of the horizontal section 290*b* of the L-shaped slot 290 causes astragal 270 to be carried upwardly and inwardly as the surfaces of the slots 278*a* in the astragal ride upwardly on the guide pins 280.

As shown in FIG. 9, the astragal system also includes a spring latch mechanism 306 similar to the latch mechanism 106 for maintaining the astragal in the upper retracted position whenever the door is opened. The spring latch system includes a leaf spring 308 having a bumper pad 312 adjacent the upper end which engages a stop surface 218*a* on the transom or header 218 of the door frame to retract the catch pin 316 from the aperture 318 in the astragal when the door is again closed. The automatic astragal system as shown in FIGS. 7–9 is especially well adapted for application on existing door installations and provides the same protective features of a built in system of the prior embodiment as shown in FIGS. 1–6.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. An automatic astragal assembly for a door comprising:

an elongated astragal housing mounted on said door and having an outwardly opening longitudinal recess therein, an elongated astragal mounted in said recess, means supporting said astragal in said recess for upward and inward relative movement in said housing in response to lifting of said astragal, means for lifting said astragal in said recess comprising a lift slide mounted on said housing for vertical movement and having an L-shaped slot defined therein with interconnecting horizontal and vertical sections and a deadlock pin engaged in said slot and secured to said astragal for elevating the same.

2. The automatic astragal assembly of claim 1 wherein said lifting means includes an arm pivotally supported relative to said housing and a bar secured to an end of said arm and depressable to elevate an opposite end of said arm to lift said slide on said housing.

3. The automatic astragal assembly of claim 1 including latch means for maintaining said astragal in an upper retracted position in said housing when said door is opened.

4. The automatic astragal assembly of claim 3 wherein said latch means includes a latch member biased toward latching engagement with said astragal and stop means for holding said latch member out of said latching engagement with said astragal when said door is closed.

5. The automatic astragal assembly of claim 4 wherein said latch member includes a latch pin adjacent the deflectable end of a spring and said astragal includes an aperture aligned to receive said latch pin when said astragal is in said upper retracted position.

6. The automatic astragal assembly of claim 1 wherein said housing includes means for interlocking attachment to a door stile and is seated in said stile between opposite side faces thereof with said recess opening between said side faces.

7. The automatic astragal assembly of claim 1 wherein said housing is of a U-shaped cross-section having one side wall attachable to an inside surface of a door stile.

8. The automatic astragal assembly of claim 7, including in combination, a second housing adapted for attachment to an inside surface of a stile on an adjacent door, said second housing including a recess adapted to receive an outer portion of said astragal when said doors are closed with stiles thereof in closely facing relation.

9. The automatic astragal assembly of claim 1 wherein said supporting means includes slot means defined in one of said astragal or said housing and pin means engaged in said slot means supported by the other of said astragal or said housing.

10. The automatic astragal of claim 9 wherein said slot means comprises a pair of vertically spaced slots on said astragal and said pin means include a pair of pins supported from said housing.

11. The automatic astragal of claim 10 wherein said slots slope inwardly and upwardly of an outer surface of said astragal.

* * * * *